US006626427B2

(12) United States Patent
Choi et al.

(10) Patent No.: US 6,626,427 B2
(45) Date of Patent: Sep. 30, 2003

(54) ADAPTIVE SHEET FEEDING ROLL

(75) Inventors: Injae Choi, Webster, NY (US); Ming Yang, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/082,008

(22) Filed: Feb. 25, 2002

(65) Prior Publication Data

US 2003/0160380 A1 Aug. 28, 2003

(51) Int. Cl.[7] ..... B65H 3/06

(52) U.S. Cl. ..... 271/119; 271/120; 271/109; 271/113; 492/30; 492/25

(58) Field of Search ..... 271/109, 113, 271/119, 120; 492/25, 30, 33

(56) References Cited

U.S. PATENT DOCUMENTS 4,381,860 A * 5/1983 Silverberg ..... 271/120
4,475,733 A * 10/1984 Benson ..... 271/120
4,759,435 A * 7/1988 Cedrone ..... 198/459.8

* cited by examiner

*Primary Examiner*—Donald P. Walsh
*Assistant Examiner*—Kaitlin Joerger
(74) *Attorney, Agent, or Firm*—Tallam I. Nguti

(57) ABSTRACT

A self-adaptive sheet feeding roll for reliably feeding, within a sheet feeding apparatus, sheets of various and different sheet weights along a sheet path. The self-adaptive sheet feeding roll includes (a) a cylindrical core having a longitudinal axis and an outer surface; (b) a compliant surface layer formed over the outer surface of the cylindrical core and having an external surface and a given layer thickness; and (c) a series of spaced apart, non-radial slots formed from the external surface into the compliant surface layer and defining a series of spaced apart blade portions within the compliant surface layer for adaptively compressing and deforming against, and responsively to, sheets of various and different sheet weights, thereby self-adjusting a normal force Fn as well as a sheet driving force Fd thereof and enabling reliable feeding, within a sheet feeding apparatus, of such sheets of various and different sheet weights.

20 Claims, 3 Drawing Sheets

ADAPTIVE SHEET FEEDING ROLL

BACKGROUND OF THE INVENTION

This invention relates generally to electrostatographic reproduction machines, and more particularly to an adaptive roll for reliably feeding sheets of various sheet weights generating various different tangential resistance forces to feeding.

Traditionally, sheet feeding rolls are employed in friction retard type sheet feeding and supply apparatus to move the top sheet from a stack of such sheets to a retard mechanism as a result of a net frictional force. The retard mechanism then allows a single substrate or sheet at a time to pass through the retard mechanism. Some such sheet feeding rolls are constructed from an elastomeric material. These rolls have a relatively high failure mode from loss of a suitable friction coefficient due to contamination, dirt build-up as well as from wear and tear.

Other such sheet feeding rolls are in the form of a series of studded metal pin wheels which act to grab or stick the top sheet in the stack and move it into the friction retard mechanism. A studded roll of this type works well for most substrate or sheet types, and has a long roll life, however, the studded roll does not handle high density substrates or sheets very well due to an ability to penetrate the surface of such substrates or sheets. Also, the studded roll does not handle transparencies satisfactorily. Further, the studded roll may leave scratch marks on the surface of substrates or sheets fed at high feed rates.

When a rotating roll is used to feed the sheet or paper by a frictional force between the sheet and roll, the maximum available feed force is determined by the product of the normal force and the coefficient of friction between the roll and the sheet which could be paper, transparencies, etc. Because the coefficient of friction is uncertain in nature, the maximum available feed force is mainly controlled by the normal force. That is, as the required feed force increases due, for example, to increases in sheet weight and stiffness, the normal force should also increase adaptively or be increased responsively in order to maintain reliable feeding.

Unfortunately, in most machines that use sheet feeding apparatus including sheet feeding rolls, the normal force is typically set to a fixed optimum value to meet the particular design requirements, additional expensive compensating components have to be included with the sheet feeding rolls for attempting to vary the normal force. Sheet feeding deficiencies such as sheet misfeeds and multi-feeds are still common.

SUMMARY OF THE INVENTION

Accordingly, in an aspect of the present invention, there is provided a self-adaptive sheet feeding roll for reliably feeding, within a sheet feeding apparatus, sheets of various and different sheet weights along a sheet path. The self-adaptive sheet feeding roll includes (a) a cylindrical core having a longitudinal axis and an outer surface; (b) a compliant surface layer formed over the outer surface of the cylindrical core and having an external surface and a given layer thickness; and (c) a series of spaced apart, nonradial slots formed from the external surface into the compliant surface layer and defining a series of spaced apart blade portions within the compliant surface layer for adaptively compressing and deforming against, and responsively to, sheets of various and different sheet weights, thereby self-adjusting a normal force Fn as well as a sheet driving force Fd thereof and enabling reliable feeding, within a sheet feeding apparatus, of such sheets of various and different sheet weights.

BRIEF DESCRIPTION OF THE DRAWINGS

The foregoing and other features of the instant invention will be apparent from a further reading of the specification, claims and from the drawings in which:

DETAILED DESCRIPTION OF THE INVENTION

While the present invention will be described hereinafter in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
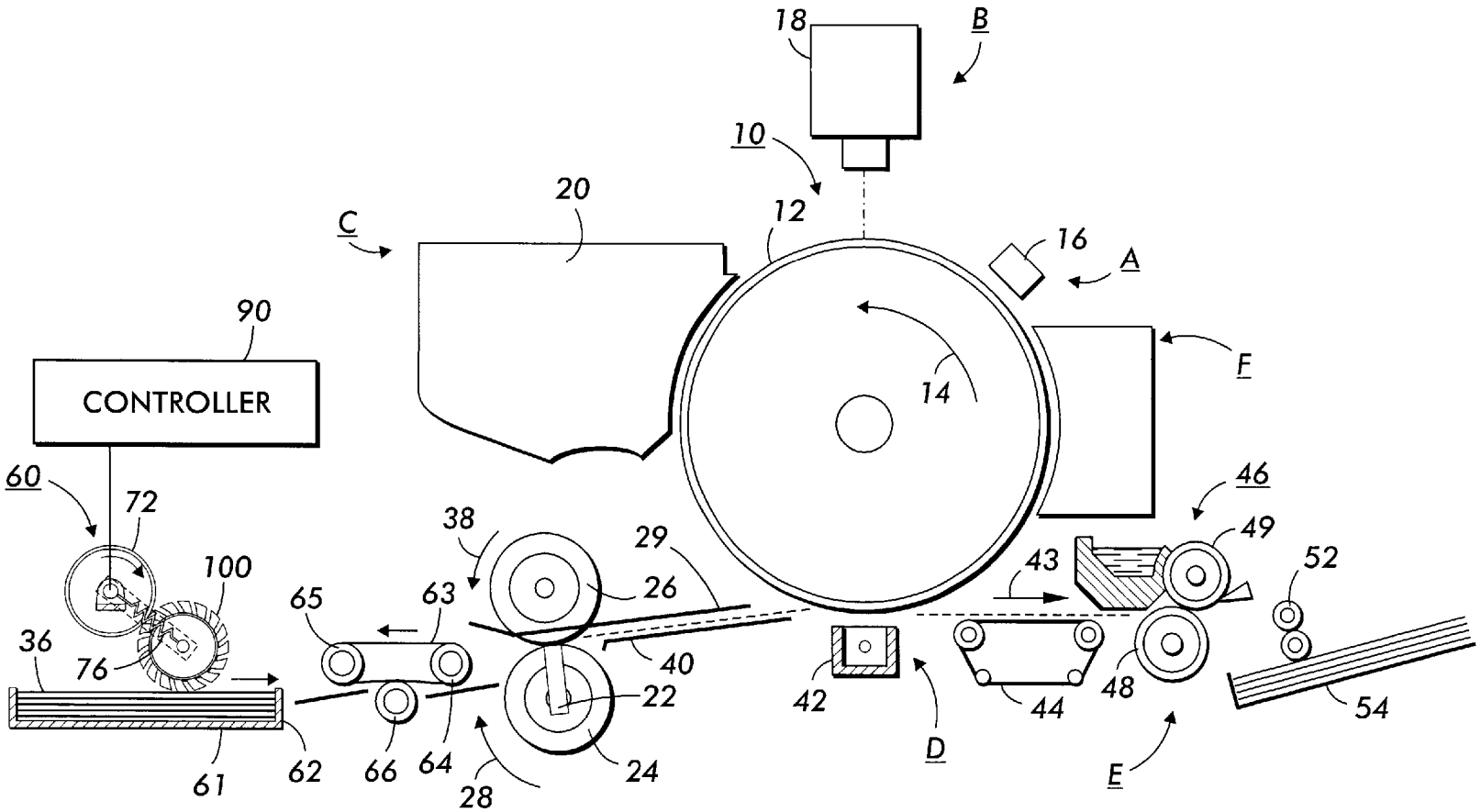
FIG. 1 is a schematic elevational view of an electrostatographic reproduction machine incorporating a sheet holding and feeding apparatus including the self-adaptive sheet feeding roll of the present invention.

For a general understanding of an electrostatographic reproduction machine in which the features of the present invention may be incorporated, reference is made to FIG. 1 which depicts schematically the various components thereof. Hereinafter, like reference numerals will be employed throughout to designate identical elements. Although the apparatus for forwarding sheets along a predetermined path is particularly well adapted for use in the electrostatographic reproduction machine of FIG. 1, it should become evident from the following discussion that it is equally well suited for use in a wide variety of devices and is not necessarily limited in this application to the particular embodiment shown herein. For example, the apparatus of the present invention will be described hereinafter with reference to feeding successive substrates or sheets, such as, copy sheets, however, one skilled in the art, will appreciate that it may also be employed for feeding successive original documents.

Since electrostatographic machines are well known in the art, the various processing stations for producing a copy of an original document are represented in FIG. 1 schematically. Each processing station will be briefly described hereinafter. As in all electrostatographic reproduction machines of the type illustrated, a drum 10 having a photoconductive surface 12 entrained about and secured to the exterior circumferential surface of a conductive substrate or sheet is rotated in the direction of arrow 14 through is the various processing stations.

Initially, drum 10 rotates a portion of photoconductive surface 12 through charging station A. Charging station A employs a conventional corona generating device, indicated generally by the reference numeral 16, to charge photoconductive surface 12 to a relatively high substantially uniform potential. Thereafter drum 10 rotates the charged portion of photoconductive surface 12 to expose station B. Exposure station B includes an exposure mechanism, indicated generally by the reference numeral 18, having a stationary, transparent platen, such as a glass plate or the like for supporting an original document thereon. Lamps illuminate the original document. Scanning of the original document is achieved by oscillating a mirror in a timed relationship with the movement of drum 10 or by translating the lamps and lens across the original document so as to create incremental light images which are projected through an apertured slit onto the charged portion of photoconductive surface 12. Irradiation of the charged portion of photoconductive surface 12 records an electrostatic latent image corresponding to the informational areas contained within the original document. Obviously, electronic imaging of page image information could be used, if desired.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming a toner powder image on photoconductive surface 12.

With continued reference to FIG. 1, a copy sheet is advanced to transfer station D by the sheet holding and feeding apparatus 60 of the present invention (to be described in detail below). As shown, sheet holding and feeding apparatus 60 advances one or more copy sheets to a retard nip formed by a belt 63 and retard roll 66. The belt 63 as illustrated is supported for rotation by drive roll 64 and idler roll 65. Within the retard nip, retard roll 66 applies a retarding force to shear any multiple sheets from the sheet being fed and forwards it to registration roller 24 and idler roller 26. Registration roller 24 is driven by a motor (not shown) in the direction of arrow 28 and idler roller 26 rotates in the direction of arrow 38 since roller 24 is in contact therewith.

In operation, sheet holding and feeding apparatus 60 operates to advance the uppermost sheet from a stack 36 of such sheets into registration rollers 24 and 26, and against registration fingers 22. Fingers 22 are actuated by conventional means in timed relation to an image on drum 12 such that the sheet resting against the fingers is forwarded toward the drum in synchronism with the image of the drum. The sheet is advanced in the direction of arrow 43 through a chute formed by guides 29 and 40 to transfer station D.

Continuing now with the various processing stations, transfer station D includes a corona generating device 42 which applies a spray of ions to the back side of the copy sheet. This attracts the toner powder image from photoconductive surface 12 to copy sheet. After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 46 includes a fuser roll 48 and a backup roll 49 defining a nip therebetween through which the copy sheet passes. After the fusing process is completed, the copy sheet is advanced by rollers 52, which may be of the same type as registration rollers 24 and 26, to catch tray 54.

Invariably, after the copy sheet is separated from photoconductive surface 12, some residual toner particles remain adhering thereto. These toner particles are removed from photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

Figure 2:
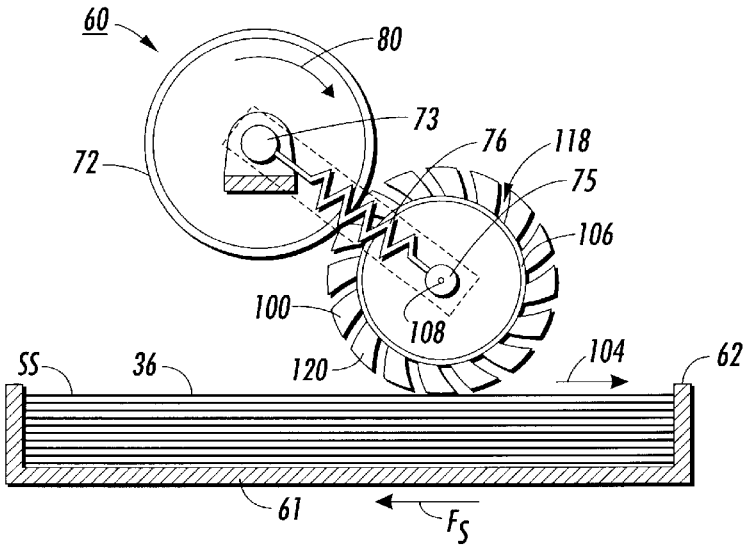
FIG. 2 is a schematic illustration of the sheet holding and feeding apparatus of FIG. 1.
Figure 3:
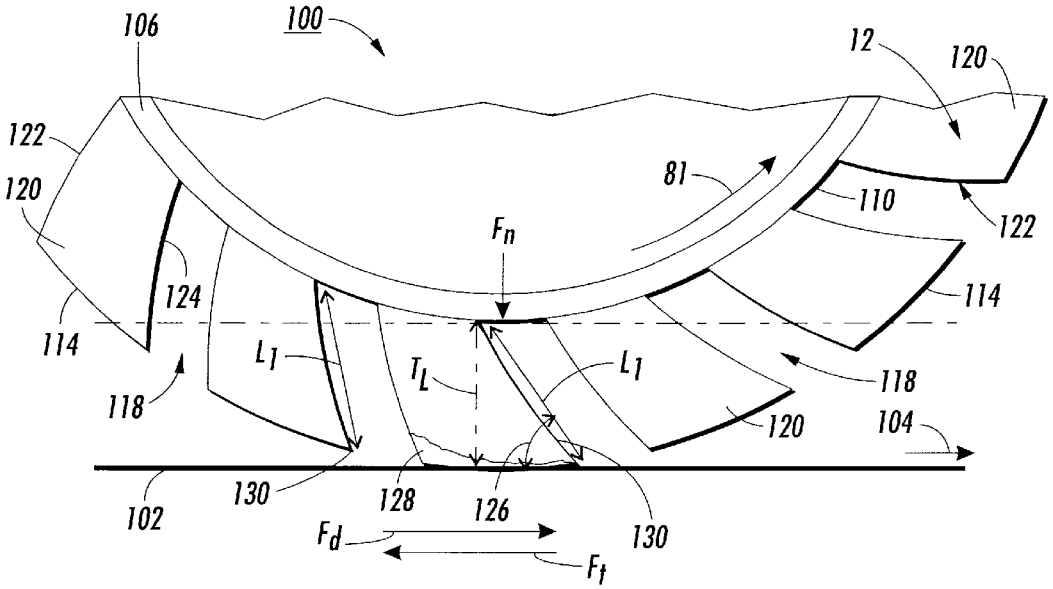
FIG. 3 is a schematic illustration of the mounting of the self-adaptive sheet feeding roll of the present invention relative to a fixed sheet feeding plane.
Figure 4:
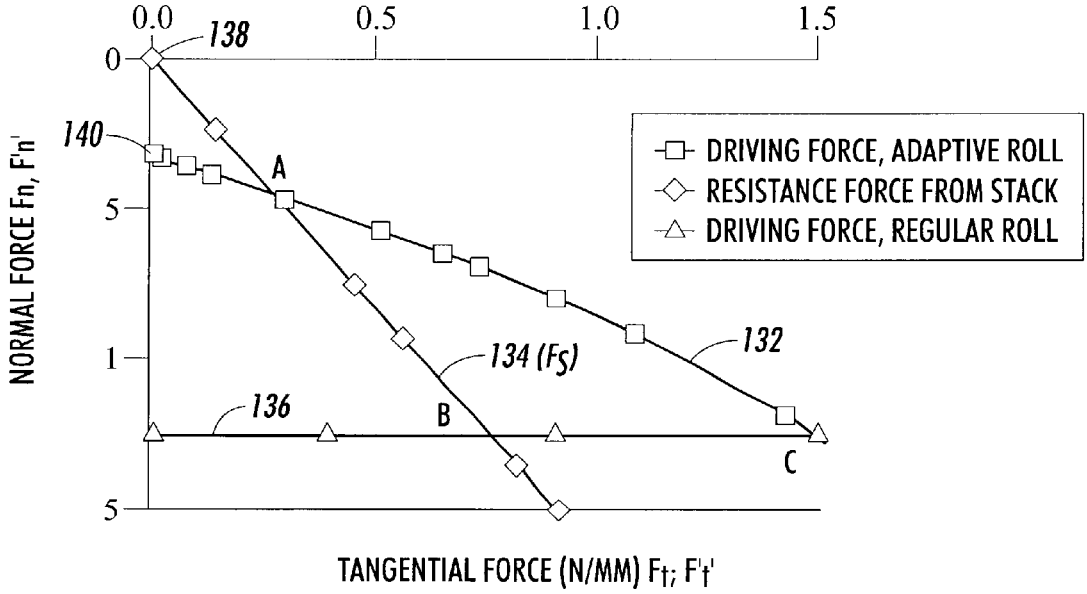
FIG. 4 is a graphical illustration of comparative force ranges between a conventional sheet feeding roll and the self-adaptive sheet feeding roll of the present invention.

Referring now to the specific subject matter of the present invention, FIGS. 2–4 depict in greater detail the adaptive roll 100 of the present invention as used in the top feeding sheet holding and feeding apparatus 60. As illustrated, the top feeding sheet holding and feeding apparatus 60 is positioned for example above a stack 36 of sheets located on platform or rigid surface 61 that has a sheet retaining wall 62 attached thereto. As shown in FIG. 2, the sheet holding and feeding apparatus 60 comprises, for example, a first roll 72 which is coupled to, and is controlled by controller 90 (FIG. 1). The first roller 72 as shown is mounted on shaft 73 that is connected to a one-way clutch (not shown) with the shaft 73 being adapted for rotation in the direction of arrow 80 by a suitable motor (not shown). First roll 72 is in driving contact with the self-adaptive sheet feeding roll 100 of the present invention (to be described in detail below) which is mounted on shaft 75 for rotation in the direction of arrow 81.

The two rolls 72 and 100 are contactedly connected to each other by a spring 76 that is attached to shafts 73 and 75. The spring maintains the contact between the rolls and shaft 73 of roll 72 is fixed in position while shaft 75 of roll 100 is movable for adjustable and controlled mounting relative to the sheet feeding plane 102. As illustrated, self-adaptive sheet feeding roll 100 is rotatable in the direction of arrow 81 to reliably feed the top sheet SS from the stack 36 of sheets which could have various and different sheet weights.

In sheet feeding apparatus such as the sheet holding and feeding apparatus 60, for example, an ideal normal force Fn on the sheet feeding roll, such as the roll 100, depends upon the weight of the sheet being fed. As the sheet weight increases, so does the ideal normal force Fn by the feed roll. Unfortunately, on conventional feed rolls, the normal force Fn is typically set to a constant value and cannot be easily adjusted if the sheet weight should change. In apparatus having such conventional feed rolls, if the normal force is set for light weight sheets, then there tends to be misfeed failures for heavy weight sheets. On the other hand, if the normal force is set for heavy weight sheets, then there tends to be multi-feed failures for light weight sheets.

Thus, in accordance with the present invention, there is provided a self-adaptive sheet feeding roll 100 for reliably feeding, within a sheet feeding apparatus 60, sheets SS of various and different sheet weights along 10 a sheet path or direction 104. The self-adaptive sheet feeding roll 100 includes (a) a cylindrical core 106 having a longitudinal axis 108 and an outer surface 110; (b) a compliant surface layer 112 formed over the outer surface 110 of the cylindrical core and having an external surface 114 and a given layer thickness TL; and (c) a series of spaced apart, non-radial slots 118 formed from the external surface 114 into the compliant surface layer 112 and defining a series of spaced apart blade portions 120 within the compliant surface layer. The series of spaced apart blade portions 120 as such are suitable, during sheet feeding, for adaptively compressing and deforming against, and responsively to, sheets SS of various and different sheet weights, thus self-adjusting the normal force Fn as well as the sheet driving force Fd thereof. This thereby enables reliable feeding, within the sheet feeding apparatus, of such sheets of various and different sheet weights.

Each slot 118 of the series of slots extends longitudinally relative to the longitudinal axis 108 of the cylindrical core 106. Additionally, each slot 118 of the series of slots has a non-radial depth Li that is greater than the given layer thickness TL of the compliant surface layer 112. Because a radius to the cylindrical core 106 is a line that extends between a center of the core and a point on its circumference, the term "non-radial" simply means in a non-radial direction. It is used here and elsewhere within this description to mean that an axis of each slot 118 will not lie along such a radius, but will instead form an angle with such a radius. For example, in FIG. 3, the line showing the depth L1 is parallel to the sides and axis of the slot 118 and forms an angle with the line showing the depth TL. The line showing the depth TL extends in a radial direction in that it passes through the center of the cylinder core 106. The compliant surface layer 112 is comprised, for example, of an elastomeric material. The outer surface 110 of the cylindrical core 106 is rigid and resists compression and deformation. The non-radial structure of the series of slots is such that each compressably deformable blade portions 120 is defined by adjacent slots 118 of the series of slots, and each blade portion 120 of the series of blade portions has a first side 122 and a second side 124. During rotation for sheet feeding, the second side 124 forms a sheet feeding angle 126 with a tangent to the external surface of the compliant surface layer. The sheet feeding angle 126 in one embodiment is an acute angle.

In other words, the self-adaptive sheet feeding roll 100 includes the cylindrical core 106 having the rigid, outer surface 110, and the compliant surface layer 112. It also includes the series of spaced apart, non-radial slots 118 cut into the compliant surface layer 112 defining the series of thick, compliant non-radial blades or blade portions 120. The thick, compliant blades or blade portions 120 are compressably deformable during sheet feeding for self-adjusting the normal force Fn as well as driving force Fd of the self-adaptive sheet feeding roll responsively according to the differences in the stiffness of the type of sheet being fed.

Advantageously, the latitude of the type and weights or stiffness of sheets can be greatly expanded. The self-adaptive sheet feeding roll 100 is also beneficial in reducing contamination thereon as well as any resulting image smear because the normal force Fn would be "just right" for the given sheet weight (see the plot of FIG. 4), and because of oscillation of its blades between their compressed and deformed state when in contact with a sheet being fed, and their free state upon exiting the sheet feeding zone.

The self-adaptive sheet feeding roll 100 is therefore structured and mounted for increasing the normal force Fn as the tangential resistance Ft to a feeding motion of each sheet increases. The compliant thick blades or blade portions 120 as formed along the circumference of the self-adaptive sheet feeding roll 100 have the first side 122 and the second side 124. The self-adaptive sheet feeding roll 100 is mounted such that the second side 124 of each blade 120 faces or is towards the sheet feeding direction 104, and such that the second side 124 forms the sheet feeding angle 126 with a tangent or with the sheet feeding plane 102.

As illustrated schematically in FIG. 2, during sheet feeding, as the tangential resistance force Ft increases, each blade 120 in contact with a sheet being fed tends to, and will react by being compressed and deformed. This is because the distance or layer thickness TL between the outer surface 110 of the roll core 106 and the contact plane or sheet feeding plane 102 is maintained constant, and in accordance with an aspect of the present invention, is made less than the length L1 of the second side 124 of each compliant blade portion 120. As such, that extra portion of each blade that is greater than the distance TL will be deformed as the extra blade material forming such portion is pushed inwardly to fit and pass through the sheet feeding zone. Therefore, the normal force Fn on the self-adaptive sheet feeding roll 100 increases responsively and self-adaptively as the tangential resistance Ft increases due to the rearrangement of the extra material on each blade portion 120.

As shown in FIG. 3, the self-adaptive sheet feeding roll 100 is, for example, driven counter-clockwise (CCW) to feed sheets SS in a sheet feeding direction 104, for example to the right. Each compliant, thick blade 120 is made for example of an elastomeric material, and will be tilted at an acute sheet feeding angle 126 relative to the sheet feeding plane 102 as shown. The sheet feeding angle 126 can for example be 50°. The height of each blade 120, which is the same as the thickness TL of the surface layer 112, and the same as the distance between the outer surface 110 of the roll core 106 and the sheet feeding plane 102, is in magnitude less than the dimension L1 of the second side 124 of each blade. For example, the blade height can be 1.5 mm, the radius of the outer surface 110 of the roll core can be 8.5 mm, and thus the radius of the external surface 114 of the self-adaptive sheet feeding roll 100 will be 10 mm.

As illustrated graphically in FIG. 4, as the tangential resistance force Ft (which is the force applied to the external surface 114 of each blade of the self-adaptive sheet feeding roll 100 by the sheet being fed) is applied to each blade 120, the blade 120 will tend to bend backwards, and then its radial length would become longer than the thickness TL of the surface layer due to such bending. Because the spacing or distance TL between the outer surface 110 of the core 106 and the sheet feeding plane 102 is maintained constant, such increase is prevented, and thus the normal force Fn (or pressure), therefore, has to increase adaptively as the extra material of the blade 120 is compressed into the spacing TL.

As illustrated in FIG. 3, from a study of stress distribution around the contact area of each blade 120 with a sheet in the sheet feeding plane 102, each such blade 120 was found to be deformed in an area 128 on the blade that is towards a direction opposite to the direction 104 of sheet feeding. The magnitude of the deformation was found to depend on the tangential resistance force Ft, so that as the driving force Fd that is required to overcome the tangential resistance force Ft increased, the blade deformation also increased, thus also increasing adaptively the normal force Fn.

Plot 132 in FIG. 4 is a plot of driving forces by the self-adaptive sheet feeding roll 100 of the present invention, and illustrates graphically a relationship between the normal force Fn and the tangential resistance force Ft from using the self-adaptive sheet feeding roll 100 of the present invention. In comparison, there is also illustrated a similar plot 136 of driving forces by a traditional or conventional sheet feeding roll. The plot 134 is of the resistance force Fs of the remaining stack of sheets on the top sheet being fed in both the conventional case and that of the self-adaptive sheet feeding roll 100 of the present invention. As can be seen, in the case of plot 136 of the conventional sheet feeding roll, the normal force F'n' is fixed or constant. However in the case of the self-adaptive sheet feeding roll 100, there is significant sensitivity, and hence variation, in the normal force Fn relative to the tangential resistance force Ft. Such variation in the normal force advantageously enables and allows expansion in the types and stiffness of various sheets that the sheet holding and feeding apparatus 60 can handle.

Note that in FIG. 4 the normal force F'n' in a conventional sheet feeding roll (plot 136) is insensitive to the sheet feeding or driving force Fd necessary to overcome resistance force, and thus the operating range in terms of tangential resistance force F't' is only between point B and point C along the line 136 which represents the constant normal force F'n' of about−1.25 N/mm. As also shown on the graph, the span A-B on the plot 134 denotes the resistance force Ft to the sheet being fed from a second sheet under the sheet being fed, (assuming there are multi-sheets under the sheet feeding roll). When using the self-adaptive sheet feeding roll 100 of the present invention, the normal force Fn becomes adaptive, and its range is between points A and C along the plot 132 as such normal force Fn changes itself according to the weight, and hence stiffness, of the type of sheet being fed.

Additionally, in the self-adaptive sheet feeding roll 100 of the present invention, because of the slots 118 separating the blades 120, strain energy on the roll due to or from frictional and compressive contact with the sheet being fed is advantageously concentrated on and limited only to the local blade 120 making feeding contact with such sheet. The concentration of such strain energy on a single blade 120 makes that particular blade oscillate upon leaving such feeding contact, thus causing the blade 120 to tend to flick off any contaminating particles thereon, such as dust.

Still referring to FIG. 4, in using the self-adaptive sheet feeding roll 100 of the present invention, there is also a general and relative reduction in the range of normal forces required for sheet feeding. This is shown for example by the difference between the high normal force points 138 on the conventional sheet feeding roll plot 136, and that 140 on the plot 132 for the self-adaptive roll 100 of the present invention. Such a reduction is believed to be beneficial. For example, in feeding of a sheet or document, a smaller normal force on a sheet feeding roll in a nip will beneficially tend to reduce, if not eliminate, the potential problem of image smear.

As can be seen, there is provided a self-adaptive sheet feeding roll for reliably feeding, within a sheet feeding apparatus, sheets of various and different sheet weights along a sheet path. The self-adaptive sheet feeding roll includes (a) a cylindrical core having a longitudinal axis and an outer surface; (b) a compliant surface layer formed over the outer surface of the cylindrical core and having an external surface and a given layer thickness; and (c) a series of spaced apart, non-radial slots formed from the external surface into the compliant surface layer and defining a series of spaced apart blade portions within the compliant surface layer for adaptively compressing and deforming against, and responsively to, sheets of various and different sheet weights, thereby self-adjusting a normal force Fn as well as a sheet driving force Fd thereof and enabling reliable feeding, within a sheet feeding apparatus, of such sheets of various and different sheet weights.

While the embodiment of the present invention disclosed herein is preferred, it will be appreciated from this teaching that various alternative, modifications, variations or improvements therein may be made by those skilled in the art, which are intended to be encompassed by the following claims:

What is claimed is:

1. A self-adaptive sheet feeding roll for reliably feeding, within a sheet feeding apparatus, sheets of various and different sheet weights along a sheet path, the self-adaptive sheet feeding roll comprising:

(a) a cylindrical core having a longitudinal axis and an outer surface;

(b) a compliant surface layer formed over said outer surface of said cylindrical core and having an external surface and a given layer thickness; and (c) a series of spaced apart slots formed from said external surface in a non-radial direction into said compliant surface layer and defining a series of spaced apart blade portions within said compliant surface layer for adaptively compressing and deforming against, and responsively to, sheets of various and different sheet weights, thereby self-adjusting a normal force Fn as well as a sheet driving force Fd thereof and enabling reliable feeding, within the sheet feeding apparatus, of such sheets of various and different sheet weights.

2. The self-adaptive sheet feeding roll of claim 1, wherein each slot of said series of slots has a non-raial depth that is greater than said given layer thickness of said compliant surface layer.

3. The self-adaptive sheet feeding roll of claim 1, wherein said compliant surface layer is comprised of an elastomeric material.

4. The self-adaptive sheet feeding roll of claim 1, wherein said outer surface of said cylindrical core is rigid and resists compression and deformation.

5. The self-adaptive sheet feeding roll of claim 1, wherein due to said non-radial structure of said series of slots, each blade portion of said series of spaced apart blade portions has a first side and a second side.

6. The self-adaptive sheet feeding roll of claim 1, wherein each space apart blade portion is compressably deformable and is defined by adjacent slots of said series of slots.

7. The self-adaptive sheet feeding roll of claim 1, wherein each slot of said series of slots extends longitudinally relative to said longitudinal axis of said cylindrical core.

8. The self-adaptive sheet feeding roll of claim 5, wherein during rotation for sheet feeding, said second side leads said first side.

9. The self-adaptive sheet feeding roll of claim 5, wherein during rotation for sheet feeding, said second side forms a sheet feeding angle with a tangent to said external surface of said compliant surface layer.

10. The self-adaptive sheet feeding roll of claim 9, wherein said sheet feeding angle is an acute angle.

11. A sheet holding and feeding apparatus comprising:

(a) a sheet holding assembly including a rigid surface for holding a stack of sheets defining a sheet feeding plane and a sheet feeding direction; and (b) a sheet feeding apparatus including a self-adaptive sheet feeding roll comprising:

(i) a cylindrical core having a longitudinal axis and an outer surface;

(ii) a compliant surface layer formed over said outer surface of said cylindrical core, said compliant surface layer having an external surface and a given layer thickness; and (iii) a series of spaced apart slots formed from said external surface in a non-radial direction into said compliant surface layer and defining a series of spaced apart blade portions within said compliant surface layer for adaptively compressing and deforming against, and responsively to, sheets of various and different sheet weights, thereby self-adjusting a normal force Fn as well as a sheet driving force Fd thereof and enabling reliable feeding, within a sheet feeding apparatus, of such sheets of various and different sheet weights.

12. The sheet holding and feeding apparatus of claim 11, wherein each slot of said series of slots has a non-radial depth that is greater than said given layer thickness of said compliant surface layer.

13. The sheet holding and feeding apparatus of claim 11, wherein said compliant surface layer is comprised of an elastomeric material.

14. The sheet holding and feeding apparatus of claim 11, wherein said outer surface of said cylindrical core is rigid and resists compression and deformation.

15. The sheet holding and feeding apparatus of claim 11, wherein due to said non-radial structure of said series of slots, each blade portion of said series of spaced apart blade portions has a first side and a second side.

16. The sheet holding and feeding apparatus of claim 11, wherein during rotation for sheet feeding, said second leads said first side.

17. An electrostatographic reproduction machine comprising:

(a) a moveable image bearing member having an image bearing surface;

(b) imaging means for forming a developable latent image on said image bearing surface of said image bearing member;

(c) a development apparatus containing developer material having toner for developing said developable latent image into a toner image;

(d) transfer means for transferring said toner image onto a copy sheet; and (e) a sheet holding and feeding apparatus including:

(i) a sheet holding assembly including a rigid surface for holding a stack of sheets defining a sheet feeding plane and a sheet feeding direction; and (ii) a sheet feeding apparatus including a self-adaptive sheet feeding roll comprising:

a cylindrical core having a longitudinal axis and an outer surface;

a compliant surface layer formed over said outer surface of said cylindrical core, said compliant surface layer having an external surface and a given layer thickness; and a series of spaced apart slots formed from said external surface in a non-radial direction into said compliant surface layer and defining a series of spaced apart blade portions within said compliant surface layer for adaptively compressing and deforming against, and responsively to, sheets of various and different sheet weights, thereby self-adjusting a normal force Fn as well as a sheet driving force Fd thereof and enabling reliable feeding, within a sheet feeding apparatus, of such sheets of various and different sheet weights.

18. The electrostatographic reproduction machine of claim 17, wherein each slot of said series of slots has a non-radial depth that is greater than said given layer thickness of said compliant surface layer.

19. The electrostatographic reproduction machine claim 17, wherein said compliant surface layer is comprised of an elastomeric material.

20. The electrostatographic reproduction machine of claim 17, wherein due to said non-radial structure of said series of slots, each blade portion of said series of spaced apart blade portions has a first side and a second side.

* * * * *